US005522358A

United States Patent [19]

Clarke

[11] Patent Number: 5,522,358

[45] Date of Patent: Jun. 4, 1996

[54] FLUID CONTROLLING SYSTEM FOR AN ENGINE

[75] Inventor: John M. Clarke, Chillicothe, Ill.

[73] Assignee: Caterpillar Inc., Peoria, Ill.

[21] Appl. No.: 522,470

[22] Filed: Aug. 31, 1995

[51] Int. Cl.[6] ..... F02M 57/04; F01L 1/28

[52] U.S. Cl. ..... 123/296; 123/79 R; 123/188.8

[58] Field of Search ..... 123/296, 79 R, 123/188.8

[56] References Cited

U.S. PATENT DOCUMENTS 1,049,123 12/1912 Mercer ..... 123/188.8
2,044,522 6/1936 Wurtele ..... 123/296
2,072,437 3/1937 Wurtele ..... 123/296
2,323,251 6/1943 Smith ..... 123/79 R
4,640,237 2/1987 Schaich ..... 123/296

*Primary Examiner*—Andrew M. Dolinar
*Attorney, Agent, or Firm*—Frank L. Hart

[57] ABSTRACT

A fluid system of an engine which has an outwardly opening engine valve controls fluid delivery and removal from first and second cylinders for controlling the position of the engine valve and injection of fuel responsive to the position of the engine piston.

7 Claims, 2 Drawing Sheets

86
64
66
72
26
30
24
25
28
22
75
68
73
74
70
76
77
20
36
32
60
34
62
18
38
82
78
80
84
15
16
14
12
8
17
10
6
4
2

FLUID CONTROLLING SYSTEM FOR AN ENGINE

TECHNICAL FIELD

The present invention relates to a system for controlling fuel, air, and exhaust passing into and from the combustion chambers of an internal combustion engine. More particularly, the invention is directed to controlling the fluids in response to engine piston position with an engine having valves that open outwardly from the combustion chamber.

BACKGROUND ART

In various constructions of engine valves and the control of fuel systems, a multiplicity of problems are encountered. Examples of troublesome constructions are engine valve contact with the piston in the event of improper engine timing, undesirably high pressures required to open the engine valve in opposition to the pressure of the combustion chamber, and resolving fuel injection timing and pressure requirements with the position of the engine piston and the various pressures within the combustion chamber.

The present invention is directed to overcome one or more of the problems as set forth above.

DISCLOSURE OF THE INVENTION

Engines have a cylinder, a piston reciprocally moveable in the cylinder, a head defining a port and a valve seat opening into said cylinder, and a valve having a valve stem. The piston, cylinder and head define a combustion chamber in which gas is pressurized in response to combustion. The engine valve is moveable between an open position spaced from said valve seat in said port and a closed position against said valve seat.

A spring is associated with the valve and adapted for biasing said valve outwardly from the engine, said valve being an outwardly opening valve. A pressurized fluid source provides a force magnitude biasing the valve in a direction opposed to the force of the spring on the valve. A first hydraulic cylinder has a piston, a head end, and a rod end. The cylinder head end has a pressure chamber. A second hydraulic cylinder has a piston, a head end and a rod end. The second hydraulic cylinder head end has a pressure chamber. The first hydraulic cylinder is connected to the second hydraulic cylinder. The rod end of the first hydraulic cylinder is connected to the piston of the second hydraulic cylinder. The piston of the second hydraulic cylinder is fixedly connected to the engine valve stem. The first and second hydraulic pistons each have a displacement area sized relative one to the other with the displacement area of the first hydraulic piston being less than the displacement area of the second hydraulic piston.

A fluid pathway extends from the first hydraulic cylinder, through the engine valve stem to a check valve which opens into the combustion chamber. Means is provided for controlling the passage of fluid from the high and low pressurized fluid sources into and from the first and second hydraulic cylinders and into the combustion chamber.

BEST MODE FOR CARRYING OUT THE INVENTION

Figure 1:
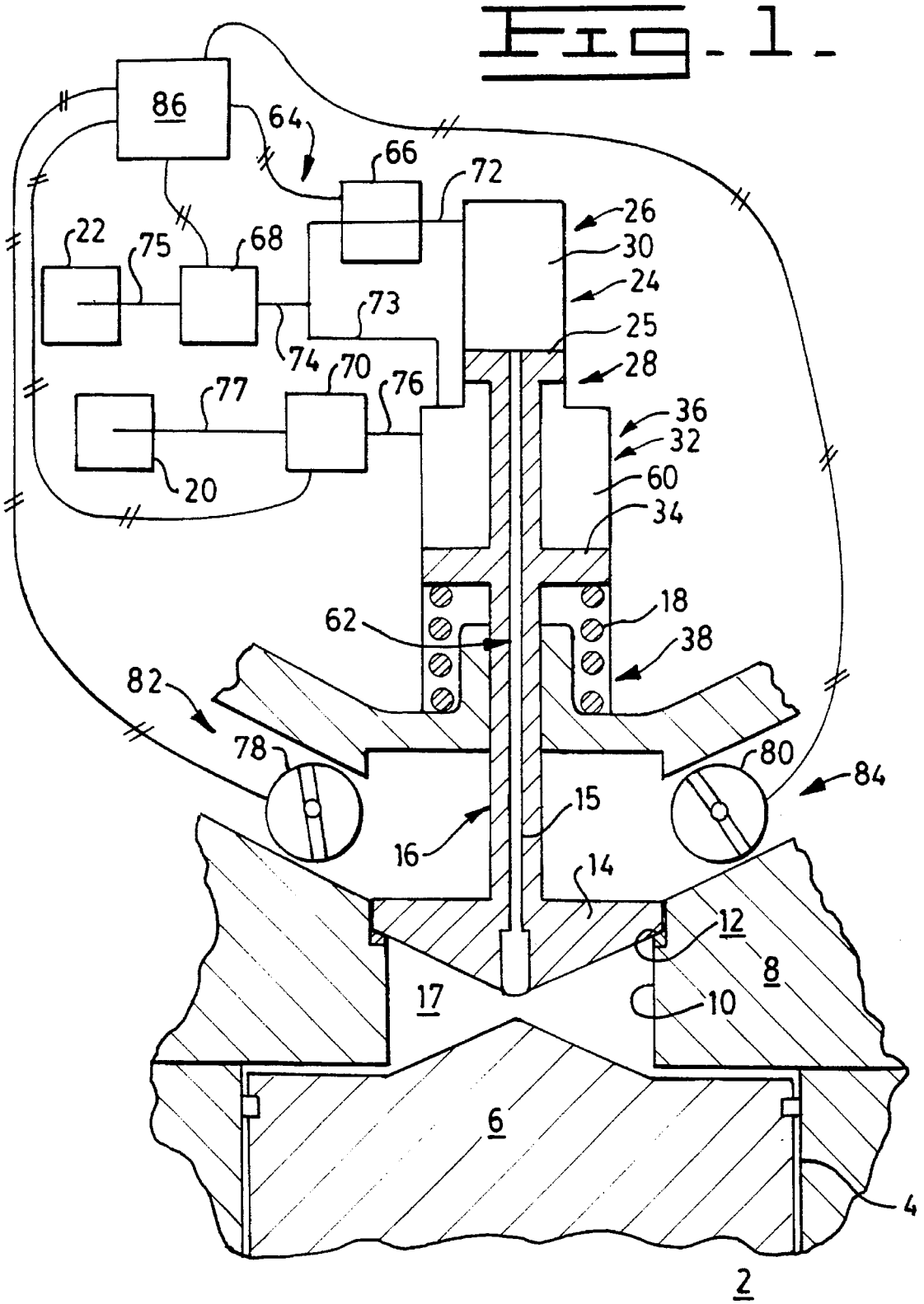
FIG. 1 is a diagrammatic view in partial section showing the system of this invention connected to one cylinder of an engine.
Figure 2:
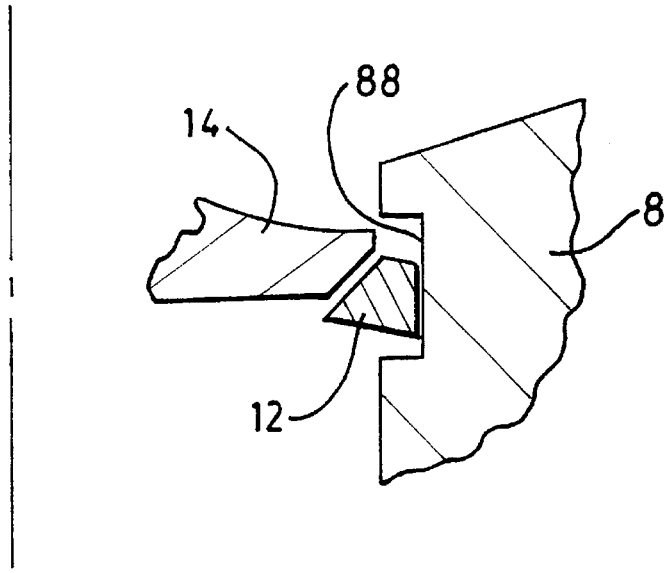
FIG. 2 is an enlarged view of the preferred valve seat.

Referring to FIGS. 1 and 2, an engine 2 has a cylinder 4, a piston 6 reciprocally moveable in the cylinder 4 a head 8 defining a port 10. The port 10 has a valve seat 12 and opens into the cylinder 4. The engine valve 14 has a valve stem 16. The engine piston 6, cylinder 4, and head 8 define a combustion chamber 17. The engine valve 14 is moveable between an open position spaced from said valve seat 12 in said port 10 and a closed position against said valve seat 12.

It should be understood that these engine elements are well known in the art and are associated with each combustion chamber of the engine and that engines generally have several so equipped combustion chambers. For purposes of brevity, the system of this invention will be described relative to only one of the combustion chambers.

A spring 18, preferably a helical spring, is associated with the engine valve 14 and adapted for biasing the engine valve 14 toward the open position. The engine valve 14 is an outwardly opening valve and by this it is meant that the valve 14 moves outwardly and in a direction away from the combustion chamber 17 during opening of the engine valve 14.

A pressurized fluid source 20 has a pressure magnitude such that the force on piston 34 sufficiently exceeds the maximum force exerted on the engine valve 14 by the spring 18 and urges the valve closed at a desired rate of speed. The system also has a low pressure fluid source 22, or sump.

A first hydraulic cylinder 24 has a piston 25, a head end 26, and a rod end 28. A second hydraulic cylinder 32 has a piston 34, a head end 36, and a rod end 38. The first and second hydraulic cylinder head ends 26,36 each have a pressure chamber 30,60.

The first hydraulic cylinder 24 is fixed connected to the second hydraulic cylinder 32. The rod end 28 of the first hydraulic cylinder 24 is fixedly connected to the piston 34 of the second hydraulic cylinder 32. The piston 34 of the second hydraulic cylinder 32 is fixedly connected to the engine valve stem 16.

The first and second hydraulic pistons 25,34 each have a displacement area associated with their respective pressure chambers 30,60 that are sized relative one to the other with the displacement area of the first hydraulic piston 25 being less than the displacement area of the second hydraulic piston 34.

A fluid pathway 62 is formed from the first hydraulic cylinder chamber 30, through the valve stem 16 and opens, through a check valve into the combustion chamber 17 of the engine 2. Means 64 is connected to the high and low pressure fluid sources 20,22 for controlling the passage of fluid into and from the first and second hydraulic cylinder chambers 30,60 and into the engine combustion chamber 17.

The means 64 for controlling the passage of fluid includes first second and third controlling means 66,68,70, such as for example an electrically actuatable valve. The first controlling means 66 is in communication with the pressure chambers 30,60 of the first and second hydraulic cylinders 25,34 via lines 72,73. The second controlling means 68 is in fluid communication with the pressure chamber 60 of the second hydraulic cylinder 32 via lines 73,74, the low pressure fluid source 22 via line 75 and the first controlling means 66. The third controlling means 70 is in fluid communication with the second hydraulic pressure chamber 60 via line 76, and the high pressure fluid source 20 via line 77. As can be seen in FIG. 1, each of the first, second and third controlling means 66,68,70 are in fluid communication with the other of said controlling means.

First and second valves 78,80 (intake, exhaust) are positioned within a respective intake passageway 82 and an exhaust passageway 84. Each of these passageways are in communication with the combustion chamber 17 and the atmosphere or the manifolds of a turbocharged engine. Such valves 78,80 are well known in the art.

A master controller 86 is connected to the first, second and third controlling means 66,68,70, the intake and exhaust valves 78,80 of the passageways 82,84 and is associated with the engine piston 6 and adapted to controllably deliver signals, preferably electrical signals, to the controlling means 66,68,70 and the valves 78,80 for opening and closing each in response to the relative position and movement of the engine piston 6.

Referring to FIG. 2, the port 10 of the engine head 8 has an axis and a circumferentially extending groove 88 and the engine valve seat 12 is a separate element positioned within the port groove 88 and is moveable along the axis of the port 10; ie, a "floating seat".

Industrial Applicability

Figure 3:
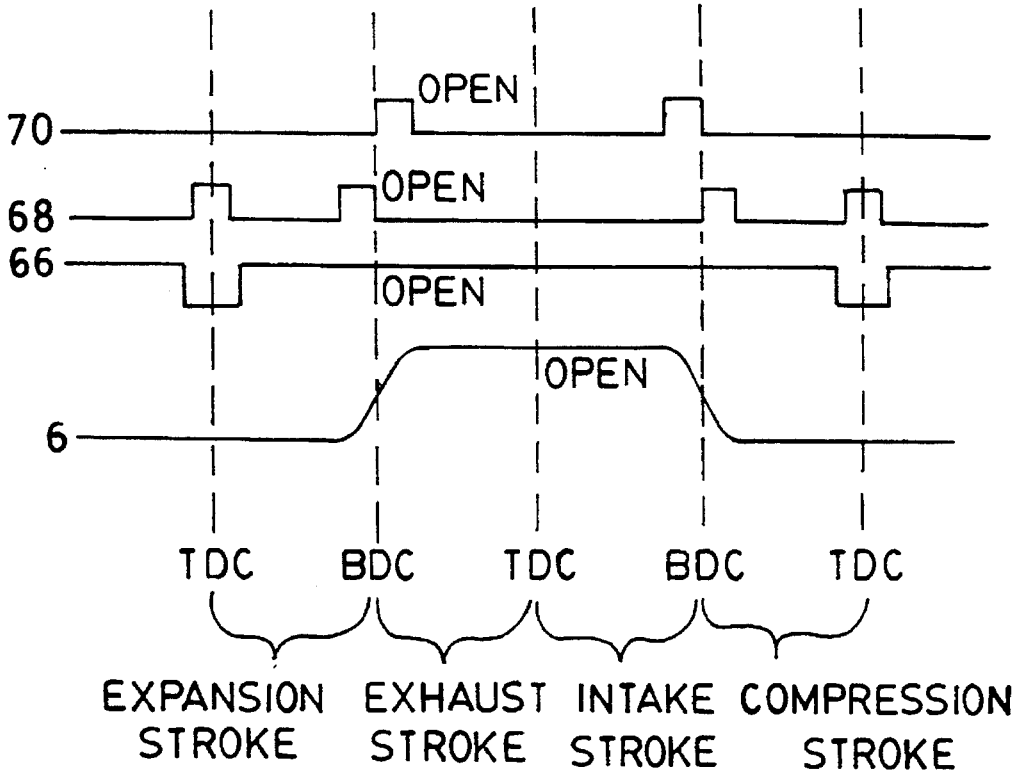
FIG. 3 is a graphic depiction of the various positions of the controlling apparatus relative to the position of the engine cylinder.

Referring to the Figures, in the operation of the system of this invention, the master controller 86 receives signals representative of the position of the engine piston 6, as is well known in the control art. The master controller delivers signals to accomplish the functions as follows and as shown in FIG. 3:

(a) reduce the pressure in the second hydraulic cylinder chamber 60 and cause fuel to be injected from the first hydraulic cylinder chamber and into the combustion chamber 17 via passageway 15 of the valve stem 16 at about TDC (top dead center) of the engine piston 6 during the compression stroke of the engine piston;

(b) equalize the pressure between the first and second hydraulic cylinder pressure chambers 30,60 immediately after TDC of the engine piston 6 during a portion of the expansion stroke of the engine piston 6 which lowers pressure to stop injection;

(c) reduce the pressure in the first and second hydraulic cylinder pressure chambers 30,60 immediately before BDC (bottom dead center) of the engine piston 6 on the expansion stroke and responsively initiate opening of the exhaust valve 80;

(d) communicate the first and second hydraulic cylinders pressure chambers 30,60 with the pressurized fluid source 20 immediately after BDC of the engine piston 6 and responsively terminate further opening of the engine valve 14 during the exhaust stroke of the engine piston thus recovering some of the valve kinetic energy;

(e) terminate communication with the first and second hydraulic cylinder pressure chambers 30,60 with the high pressure fluid source 20 while maintaining the first and second hydraulic cylinder pressure chambers 30,60 in communication with one another immediately after BDC of the engine piston 6 during the remainder of the exhaust stroke and a portion of the intake stroke of the engine piston for latching the valve 14 in an open position;

(f) communicate the first and second hydraulic cylinder pressure chambers 30,60 with the high pressure fluid source 20 immediately before BDC of the engine piston 6 intake stroke and responsively initiate closing of the engine valve 14; and (g) terminate fluid communication of the first and second hydraulic cylinder pressure chambers 30,60 with the high pressure fluid source 20 and maintaining said first and second hydraulic cylinder pressure chambers 30,60 in fluid communication immediately after BDC of the engine piston 6 for terminating further closing of the engine valve 14 at the start of the compression stroke of the engine piston.

One skilled in the art can, from a study of the drawings, see how the various controlling means and valves function relative to one another and how the dual cylinders 24,32 having different displacement areas provide the power required for fuel injection.

Other aspects objects, and advantages of this invention can be obtained from a study of the drawings, the disclosure and the appended claims.

I claim:

1. In an engine having a cylinder, a piston reciprocally moveable in the cylinder, a head defining a port and a valve seat opening into said cylinder, and an engine valve having a valve stem, said engine piston, cylinder and head defining a combustion chamber in which gas is pressurized in response to combustion, said engine valve being moveable between an open position spaced from said valve seat in said port and a closed position against said valve seat, the improvement comprising:

a spring associated with the engine valve and adapted for biasing said engine valve toward the open position, said engine valve being an outwardly opening valve;

a pressurized fluid source having a pressure magnitude biasing the valve in a direction opposed to the force of the spring on the valve;

a low pressure fluid source;

a first hydraulic cylinder having a piston, a head end, and a rod end, said first hydraulic cylinder head end having a pressure chamber;

a second hydraulic cylinder having a piston, a head end, and a rod end, said second hydraulic cylinder head end having a pressure chamber, said first hydraulic cylinder being fixedly connected to the second hydraulic cylinder, said rod end of the first hydraulic cylinder being fixedly connected to the piston of the second hydraulic cylinder, said piston of the second hydraulic cylinder being fixedly connected to the engine valve stem, and said first and second hydraulic pistons each having a displacement area sized relative one to the other with the displacement area of the first hydraulic piston being less than the displacement area of the second hydraulic piston;

a fluid pathway from the first hydraulic cylinder pressure chamber, through the valve stem and into the combustion chamber;

means connected to the high and low pressure fluid sources for controlling the passage of fluid into and from the first and second hydraulic cylinder pressure chambers and into the combustion chamber.

2. A system, as set forth in claim 1, wherein the means for controlling the passage of fluid includes:

a first controlling means in fluid communication with the pressure chamber of the first and second hydraulic cylinders;

a second controlling means in fluid communication with the pressure chamber of the second hydraulic cylinder and the low pressure fluid source; and a third controlling means in fluid communication with the second hydraulic cylinder pressure chamber and the high pressure fluid source, each of said first, second, and third controlling means being in fluid communication with the other controlling means.

3. A system, as set forth in claim 2, including first and second valves each positioned within a respective intake passageway and an exhaust passageway, said intake and exhaust passageways each being in communication with the combustion chamber and the atmosphere.

4. A system, as set forth in claim 3, including a controller connected to the first, second and third controlling means and the intake and outlet valves and being associated with the engine piston and adapted to controllably deliver signals to said controlling means and said valves for opening and closing each in response to the relative position and movement of the engine piston.

5. A system, as set forth in claim 4, wherein said master controller delivers signals to:

(a) reduce the pressure in the second hydraulic cylinder pressure chamber and cause fuel to be injected from the first hydraulic cylinder and into the combustion zone at about TDC of the engine piston during the compression stroke of the engine piston;

(b) equalize the pressure between the first and second hydraulic cylinder pressure chambers immediately after TDC of the engine piston during a portion of the expansion stroke of the engine piston;

(c) reduce the pressure in the first and second hydraulic cylinder pressure chambers immediately before BDC of the engine piston on the expansion stroke and responsively initiate opening of the valve to exhaust the combustion chamber;

(d) communicate the first and second hydraulic cylinder pressure chambers with the pressurized fluid source immediately after BDC of the engine piston and responsively terminating further opening of the engine valve during the exhaust stroke of the engine piston;

(e) terminate communication with the first and second hydraulic cylinder pressure chambers with the pressurized fluid source while maintaining the first and second hydraulic cylinder pressure chambers in communication with one another immediately after BDC of the engine piston during the remainder of the exhaust stroke and a portion of the intake stroke of the engine piston;

(f) communicate the first and second hydraulic cylinders with the high pressure fluid source immediately before BDC of the engine piston in the intake stroke and responsively initiating closing of the engine valve; and (g) terminate fluid communication of the first and second hydraulic cylinder pressure chambers with the high pressure fluid source and maintaining said first and second hydraulic cylinder pressure chambers in fluid communication immediately after BDC of the engine cylinder for terminating further closing of the engine valve at the start of the compression stroke of the engine piston.

6. A system, as set forth in claim 5, including opening the first controlling valve and closing the second controlling valve in response to signals received from the master controller at about TDC of the engine piston after the exhaust stroke of the engine piston and closing the first controlling valve and opening the second controlling valve in response to signals received from the controller after BDC of the engine piston after the expansions stroke of the engine piston.

7. A system, as set forth in claim 2, wherein said engine port has an axis and a circumferentially extending groove and said engine valve seat is a separate element positioned within the port groove and being moveable along the axis of the port.

* * * * *